US005514014A

United States Patent [19]

Ogino et al.

[11] Patent Number: 5,514,014

[45] Date of Patent: May 7, 1996

[54] OUTBOARD DRIVE TRANSMISSION

[75] Inventors: Hiroshi Ogino; Akihiro Onoue, both of Hamamatsu, Japan

[73] Assignee: Sanshin Kogyo Kabushiki Kaisha, Shizuoka, Japan

[21] Appl. No.: 346,383

[22] Filed: Jan. 29, 1994

[30] Foreign Application Priority Data

Oct. 4, 1993 [JP] Japan ..... 5-271255
Nov. 29, 1993 [JP] Japan ..... 5-298250

[51] Int. Cl.[6] ..... B63H 5/16

[52] U.S. Cl. ..... 440/75

[58] Field of Search ..... 440/75, 79, 80, 440/81; 416/129 R, 129 A, 130, 128

[56] References Cited

U.S. PATENT DOCUMENTS 537,612 4/1895 Leathers .
599,125 2/1898 Fefel .
624,674 5/1899 Painton .
938,911 11/1909 Taylor .
1,807,254 5/1931 Piano .
1,813,552 7/1931 Stechauner .
1,853,694 4/1932 Melcher .
2,058,361 10/1936 Sherwood .
2,064,195 12/1936 De Michelis .
2,347,906 5/1944 Hatcher .
2,372,247 3/1945 Billing .
2,672,115 3/1954 Conover .
2,987,031 6/1961 Odden .
2,989,022 6/1961 Lundquist .
3,478,620 11/1969 Shimanckas .
3,769,930 11/1973 Pinkerton .
4,529,387 7/1985 Brandt .
4,540,369 9/1985 Caires .
4,619,584 10/1986 Brandt .
4,642,059 2/1987 Nohara .
4,741,670 5/1988 Brandt .
4,767,269 8/1988 Brandt .
4,790,782 12/1988 McCormick .
4,792,314 12/1988 McCormick .
4,793,773 12/1988 Kinouchi et al. ..... 416/129 A
4,795,382 1/1989 McCormick .
4,828,518 5/1989 Kouda et al. .
4,832,570 5/1989 Solia .
4,832,636 5/1989 McCormick .
4,840,136 6/1989 Brandt .
4,887,982 12/1989 Newman et al. .
4,887,983 12/1989 Bankstahl et al. .
4,897,058 1/1990 McCormick .
4,932,907 6/1990 Newman et al. .
4,963,108 10/1990 Koda et al. .
4,993,848 2/1991 John et al. .
5,009,621 4/1991 Bankstahl et al. .
5,017,168 5/1991 Ackley .
5,030,149 7/1991 Fujita .
5,186,609 2/1993 Inoue et al. .
5,230,644 7/1993 Meisenburg et al. .
5,232,386 8/1993 Gifford .
5,249,995 10/1993 Meisenburg et al. .
5,342,228 8/1994 Magee et al. .
5,344,349 9/1994 Meisenburg et al. .
5,352,141 10/1994 Shields et al. .
5,366,398 11/1994 Meisenburg et al. .

FOREIGN PATENT DOCUMENTS 28093 1/1989 Japan ..... 440/80

*Primary Examiner*—Jesus D. Sotelo
*Attorney, Agent, or Firm*—Knobbe, Martens, Olson & Bear

[57] ABSTRACT

A transmission for a counter-rotating propeller system of a watercraft outboard drive has a compact arrangement so as to occupy less space in the lower unit of the outboard drive and thus provide increased flow area for exhaust discharge. The transmission includes a pair of counter-rotating gears. A front clutch selectively drives a main propulsion shaft by engaging either of the gears. A rear clutch drives an outer propulsion shaft by engaging the rear gear. The rear gear includes a bearing hub that receives the rear clutch which moves within the bearing hub between an engagement position and a non-engagement position. The overlapping arrangement between the rear gear and the rear clutch reduces the axial length of the transmission to present a compact arrangement of these components.

31 Claims, 5 Drawing Sheets

OUTBOARD DRIVE TRANSMISSION

BACKGROUND OF THE INVENTION

1. Field of the Invention

The present invention relates in general to a marine propulsion system, and more particularly to a transmission for a propulsion system of an outboard drive.

2. Description of Related Art

Many outboard drives of a marine watercrafts employ forward/neutral/reverse transmissions together with a dual propeller propulsion system. Such transmissions are common in both outboard motors and in outboard drive units of inboard/outboard motors.

These transmissions typically include a driving bevel gear and a pair of oppositely rotating driven bevel gears. Each driven gear includes a hub that is journaled within a lower unit of the outboard drive. A front dog clutch of a dual clutch assembly is interposed between the pair of oppositely rotating gears. In this position, the front dog clutch moves between positions in which the clutch engages the gears. The front dog clutch selectively couples an inner propeller shaft to one of the driven gears to rotate a first propeller in either a forward or a reverse direction.

The transmission also includes a second dog clutch that is positioned to the rear side of the rear driven gear hub. The rear clutch selectively engages corresponding teeth formed on the rear side of the hub of the rear gear to drive an outer propeller shaft.

Such prior transmission designs tend to occupy a significant amount of space in the lower unit which also houses an exhaust passageway for the discharge of engine exhaust. Outboard drives commonly discharge engine exhaust beneath the water level of the body of water in which the outboard drive is operated in order to silence exhaust noise. For this purpose, the exhaust system passes through the lower unit and the propulsion device, and discharges behind the propulsion device at a lower pressure region produced by the propulsion device.

The large size of prior transmission used with counter-rotational propulsion systems commonly leaves less than adequate space for the exhaust passage though the lower unit. Higher back pressure results, and the exhaust tends not to discharge smoothly. Engine performance consequently suffers.

With the direction in the marine industry towards larger engines (i.e., larger cylinder bores or increased number of cylinders), this problem becomes more acute. It becomes necessary to increase the flow area of the exhaust passage through the lower unit in order to discharge exhaust gas smoothly. The lower units thus have increased in size to accommodate the larger exhaust passages with the current transmission designs. An increased size in the lower unit, however, undesirably increases the resistance to fluid flow around the lower unit, i.e., undesirably increases the drag on the lower unit.

SUMMARY OF THE INVENTION

A need therefore exists for a transmission for a counter-rotational propulsion system which occupies a smaller volume in the lower unit than prior designs so as to provide a larger exhaust flow area through the lower unit without increasing the overall size of lower unit.

In accordance with one aspect of the present invention, a transmission for a watercraft outboard drive presents a compact construction. The transmission includes first and second counter-rotating gears. A first clutch is connected to a first propulsion shaft and is adapted to selectively engage either the first gear or the second gear. The transmission also includes a second clutch which is coupled to the first clutch and is connected to a second propulsion shaft. The second clutch selectively engages the second gear in a manner in which the second gear receives a substantial portion of the body of the second clutch with the second clutch engaging the second gear.

In accordance with another aspect of the present invention, a transmission for a watercraft outboard drive includes first and second counter-rotating gears of which at least one of the gears includes a hollow bearing hub. A clutch of the transmission is at least partially positioned within the hub and moves therein. The clutch specifically moves within the hub from an engagement position, in which the clutch engages the gear, to a non-engagement position, in which the clutch does not engage the gear.

In accordance with an additional aspect of the present invention, a compact transmission for a watercraft outboard drive includes first and second counter-rotating gears. A first clutch of the transmission is adapted to selectively engage at least the first gear and is connected to a first propulsion shaft. The transmission also includes a second clutch which is coupled to the first clutch and is connected to a second propulsion shaft. The first and second propulsion shafts extend in an axial direction. The second clutch selectively engages at least the second gear. At least one of the gears and at least one of the clutches overlap with each other in the axial direction so as to reduce an overall length of the transmission in the axial direction.

An additional aspect of the present invention involves an outboard drive for a watercraft which comprises coaxial propeller shafts which extend in a rearward direction from a transmission. The transmission comprises a front rotating gear and a rear counter-rotating gear. A clutching mechanism is configured to selectively couple the propulsion shafts with the gears to simultaneously drive the propulsion shafts in opposite directions relative to each other under a first driving condition. The clutching mechanism also couples one of the propulsion shafts with one of the gears under a second drive condition. The clutching mechanism is arranged forward of the rear end of the rear gear of the transmission to reduce the overall axial length of the transmission.

In accordance with another aspect of the present invention, an outboard drive for a watercraft includes an inner propulsion shaft and a hollow outer propulsion shaft. The propulsion shafts are positioned coaxially with each other. A transmission with front and rear counter-rotating gears is selectively coupled to the propulsion shafts by a clutching mechanism. The outer shaft is arranged so as to extend forward of a rear end of the rear gear so as to reduce the size of the transmission.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF PREFERRED EMBODIMENTS

Figure 1:
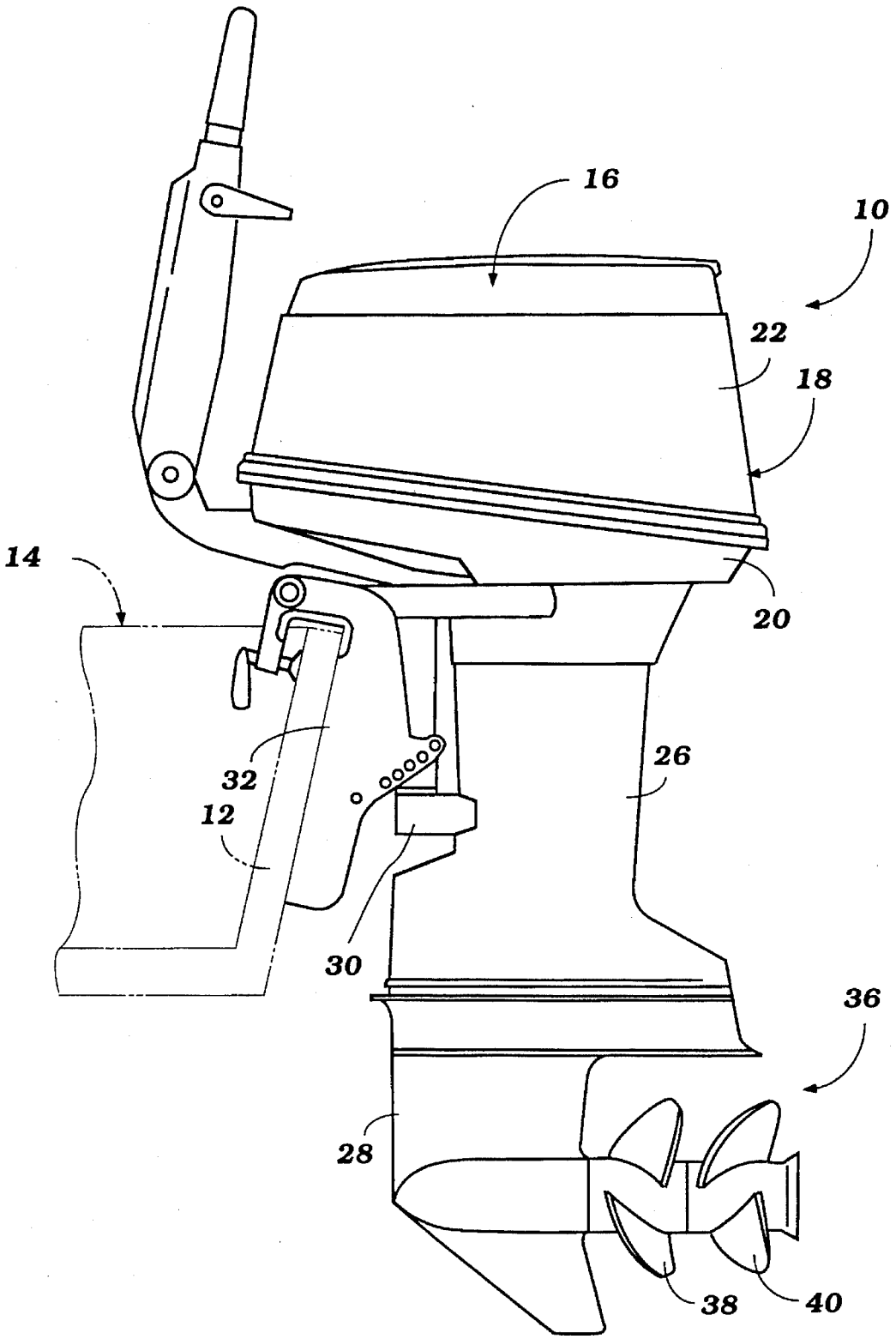
FIG. 1 is a side elevational view of an outboard drive which embodies a transmission in accordance with a preferred embodiment of the present invention.

FIG. 1 illustrates a marine outboard drive 10 configured in accordance with a preferred embodiment of the present invention. In the illustrated embodiment, the outboard drive 10 is depicted as an outboard motor for mounting on a stern 12 of a watercraft 14. It is contemplated, however, that those skilled in the art will readily appreciate that the present invention can be applied to stern drive units of inboard-outboard motors and to other types of watercraft drive units as well.

In the illustrated embodiment, the outboard drive 10 has a power head 16 which includes an engine. A conventional protective cowling 18 surrounds the engine. The cowling 18 desirably includes a lower tray 20 and a top cowling member 22. These components 20, 22 of the protective cowling 18 together define an engine compartment which houses the engine.

The engine is mounted conventionally with its output shaft (i.e., crankshaft) rotating about a generally vertical axis. The crankshaft (not shown) drives a drive shaft 24 (FIG. 2), as known in the art. The drive shaft 24 depends from the power head 15 of the outboard drive 10.

A drive shaft housing 26 extends downward from the lower tray 20 and terminates in a lower unit 28. As known in the art, the drive shaft 24 extends through and is journaled within the drive shaft housing 26.

A steering bracket 30 is attached to the drive shaft housing 26 in a known matter. The steering bracket 30 also is pivotably connected to a clamping bracket 32 by a pin 34. The clamping bracket 32, in turn, is configured to attach to a transom 12 of the watercraft 14. This conventional coupling permits the outboard drive 10 to be pivoted relative to the steering bracket 30 for steering purposes, as well as to be pivoted relative to the pin 34 to permit adjustment to the trim position of the outboard drive 10 and for tilt up of the outboard drive 10. Although not illustrated, it is understood that a conventional hydraulic tilt and trim cylinder assembly, as well as a conventional hydraulic steering cylinder assembly could be used as well with the present outboard drive 10.

The engine of outboard motor drives a propulsion device 36, such as, for example, a propeller, a hydrodynamic jet, or the like. In the illustrated embodiment of FIG. 1, the propulsion device 36 is a counter-rotating propeller device that includes a front propeller 38 designed to spin in one direction and to assert a forward thrust, and a rear propeller 40 designed to spin in the opposite direction and to assert a forward thrust.

Figure 2:
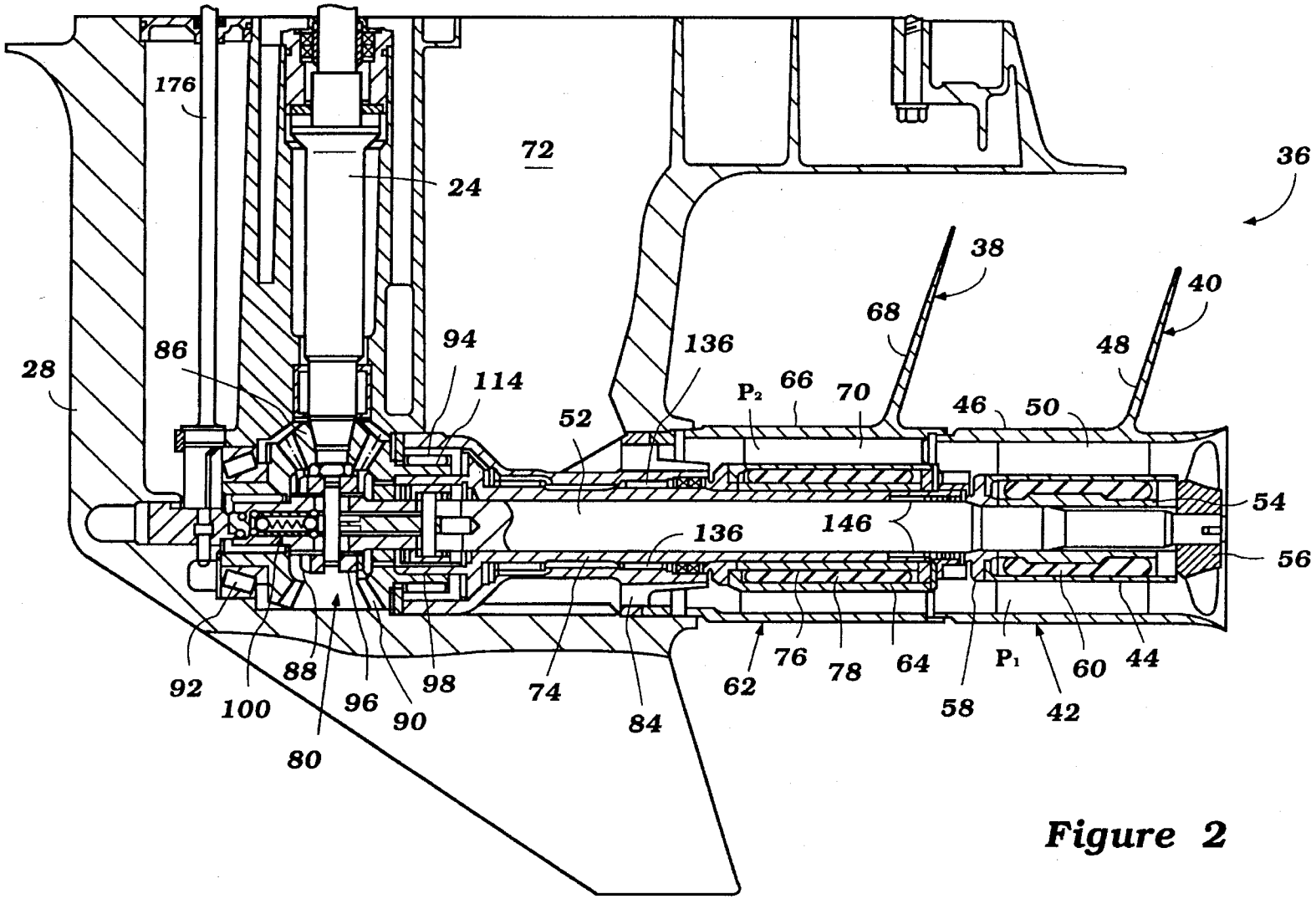
FIG. 2 is a sectional side elevational view of a lower unit of the outboard drive of FIG. 1 illustrating the transmission.

FIG. 2 illustrates the components of the front and rear propellers 38, 40. The rear propeller 40 includes a boss 42 which is formed in part by an inner sleeve 44 and an outer sleeve 46 to which the propeller blades 48 are integrally formed. A plurality of radial ribs 50 extend between the inner sleeve 44 and the outer sleeve 46 to support the outer sleeve 46 about the inner sleeve 44 and to form a passage $P_1$ through the propeller boss 42. Engine exhaust is discharged through the passage $P_1$, as known in the art.

An inner propulsion shaft 52 drives the rear propeller boss 42. For this purpose, the rear end of the inner shaft 52 carries an engagement sleeve 54 having a spline connection with the rear end of the inner shaft 52. The sleeve 54 is fixed to the rear end of the inner shaft 52 between a nut 56 threaded on the rear end of the shaft 52 and an annular retainer ring 58 positioned between the front and rear propellers 38, 40. An elastic bushing 60 is interposed between the engagement sleeve 54 and the rear propeller boss 42 and is compressed therebetween. The bushing 60 is secured to the engagement sleeve 54 by a heat process known in the art. The frictional engagement between the boss 42, the elastic bushing 60, and the engagement sleeve 54 is sufficient to transmit rotational forces from the sleeve 54, driven by the inner propulsion shaft 52, to the rear propeller blades 48.

The front propeller 38 likewise includes a front propeller boss 62. The front propeller boss 62 has an inner sleeve 64 and an outer sleeve 66. Propeller blades 68 of the front propeller 38 are integrally formed on the exterior of the outer sleeve 64. Ribs 70 interconnect the inner sleeve 66 and the outer sleeve 64 and form an axially extending passage $P_2$ between the sleeves 64, 66. The passage $P_2$ communicates with a conventional exhaust discharge passage 72 in the lower unit and with the exhaust passage of the rear propeller boss $P_1$.

An outer shaft 74 carries the front propeller 38. As best seen in FIG. 2, the rear end portion of the outer shaft 74 carries a front engagement sleeve 76 in driving engagement thereabout by a spline connection. The front engagement sleeve 76 is secured onto the outer shaft between the annular retaining ring 58 and the lower unit 28.

A front annular elastic bushing 78 surrounds the front engagement sleeve 76. The bushing 78 is secured to the sleeve 76 by heat process known in the art.

The front propeller boss 62 surrounds the elastic bushing 78, which is held under pressure between the boss 62 and the sleeve 76 in frictional engagement. The frictional engagement between the propeller boss 62 and the bushing 78 is sufficient to transmit a rotational force from the sleeve 76 to the propeller blades 68 of the front propeller boss 62.

As seen in FIG. 2, the drive shaft 24 extends from the drive shaft housing 26 into the lower unit 28 where a transmission 80 selectively couples the drive shaft 24 to the inner propulsion shaft 52 and to the outer propulsion shaft 74. As described in greater detail below, the transmission 80 advantageously is a forward/neutral/reverse-type transmission which simultaneously drives the inner and outer propulsion shafts 52, 74 in a first direction and in a second counter direction, respectively. The propulsion shafts 52, 74 in turn extend from the transmission 80, through a bearing sleeve 82 of the lower unit 28. A front end ring 84, which is attached to the lower unit 28, secures the bearing casing 82 to the lower unit 28.

The drive shaft 24 carries a drive gear 86 at its lower end, which is disposed within the lower unit 28 and which forms a portion of the transmission 80. The drive gear 86 preferably is a bevel type gear.

The transmission 80 also includes a pair of counter-rotating driven gears 88, 90 that are in mesh engagement with the drive gear 86. The pair of driven gears 88, 90 preferably are positioned on diametrically opposite sides of the drive gear 86 and are suitably journaled within the lower unit 28 by front and rear bearing assemblies 92, 94, respectively, as described below.

FIG. 2 also illustrates a front clutch 96 and a rear clutch 98 of the present transmission 80. In the illustrated embodiment, a plunger 100 interconnects the clutches 96, 98 for simultaneous operation. As discussed in detail below, the front clutch 96 selectively couples the inner propulsion shaft 52 to either to the front gear or to the rear gear. The rear clutch 98 selectively couples the outer propulsion shaft 74 to the rear gear 90. In the illustrated embodiment, the clutches 96, 98 are positive clutches, such as, for example, dog clutches; however, it is understood that the present transmission could be designed with friction-type clutches. The individual components of the present transmission 80 will now be described in detail.

Figure 3:
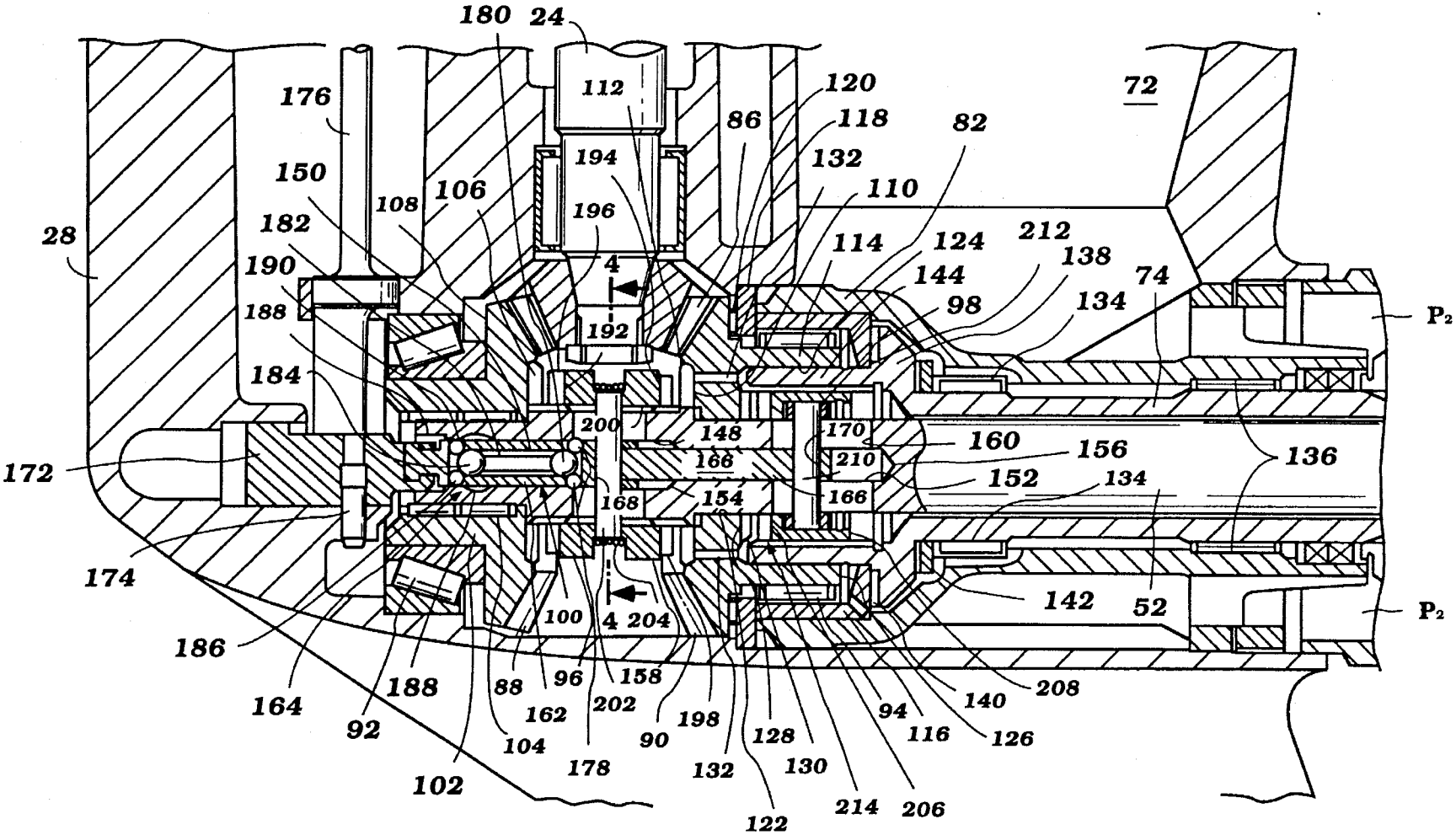
FIG. 3 is an enlarged, sectional side elevational view of the transmission of FIG. 2.

With reference to FIG. 3, each driven gear 88, 90 of the transmission 80 is positioned at about a 90° shaft angle with the drive gear 86. That is, the propulsion shafts 52, 74 and the drive shaft 24 desirably intersect at about a 90° shaft angle; however, it is contemplated that the drive shaft 24 and the propulsion shafts 52, 74 can intersect at almost any angle.

In the illustrated embodiment, the pair of driven gears are a front bevel gear 88 and an opposing rear bevel gear 90. The front gear 88 includes a bearing hub 102 which is journaled within the lower unit by the front thrust bearing 92. The front thrust 92 bearing rotatably supports the front gear 88 in mesh engagement with the drive gear 86.

The hub 102 has a central bore through which the inner propulsion shaft 52 passes when assembled. A plurality of needle bearings 104 journal the inner propulsion shaft 52 within the central bore of the front gear hub 102. As seen in FIG. 3, the inner propulsion shaft includes a step diameter section to receive the needle bearings 104 in this location.

The front gear 88 also includes a series of teeth 106 formed on an annular rear facing engagement surface 108. The teeth 106 positively engage the front clutch 96 of the transmission 80, as discussed below.

As seen in FIG. 3, the rear gear 90 also includes an annular front engagement surface 110 which carries a series of clutching teeth 112. The teeth 112 are configured to positively engage the front clutch 96 of the transmission 80, as discussed below.

The rear gear 90 includes a bearing hub 114 which is suitably journaled within the bearing casing 82 of the lower unit 28 by the needle bearing assembly 94. The rear bearing assembly 94 rotatably supports the rear gear 90 in mesh engagement with the drive gear 86. The needle bearing assembly 94 includes an outer cage 116 that is received and retained within an enlarged forward portion of the bearing casing 82 by a retainer ring 118. A thrust bearing assembly 120 is interposed between the rear gear 90 and the retainer ring 118 to take the thrust loading on the rear gear 90.

The bearing hub 114 of the rear gear 90 advantageously has a hollow shape with a stepped diameter formed by an inner bore 122 and a counterbore 124. The inner bore 120 extends entirely through the gear 90 from the front engagement surface 116 to a rear end 126 of the hub 114. The inner bore 120 has a sufficiently sized diameter to receive the inner propulsion shaft 52 when assembled.

The counterbore 124 extends into the hub 114 from its rear end 125 and terminates at a rear engagement surface 128 defined within the hollow bearing hub 114. The counterbore 124 has a sufficiently sized diameter to receive an end of the outer propulsion shaft 74 and a substantial portion of the rear clutch 98. As used herein, "a substantial portion" of the clutch 98 means at least a portion of the clutch sleeve in addition to the clutching element (e.g., teeth, cone, etc.).

The rear engagement surface 128 of the rear gear hub 114 desirably lies generally parallel to the front engagement surface 110 and generally perpendicular to the axis of the inner bore 122. The rear engagement surface 128 carries a series of clutching teeth 130 which engage a portion of the rear clutch 98 as discussed below.

The rear gear 90 also includes a plurality of lubricant passages 132 that extend through the gear 90 between the front and rear engagement surfaces 110, 128. These passages 132 allow lubricant flow from a main lubricant sump between the driven gears 88, 90 into the counterbore 122 in which the rear clutch 98 operates, as described below.

As best seen in FIG. 3, the inner propulsion shaft 52 and the hollow outer propulsion shaft 74 extend from the transmission 80 through the bearing casing 82. The bearing casing 82 rotatably supports the outer propulsion shaft 74, with the inner propulsion shaft 52 journaled within the outer propulsion shaft 74. A front needle bearing assembly 134 journals a front end of the outer propulsion shaft 136 within the bearing casing 82. And, as best seen in FIG. 2, a rear needle bearing assembly 136 supports the outer propulsion shaft 74 at an opposite end of the bearing casing 82 from the front needle bearing assembly 134.

The outer propulsion shaft 74 also includes an integrally formed thrust flange 138 located forward of the front needle bearing assembly 134. The thrust flange 138 has a forward facing thrust surface that engages a thrust bearing assembly 140 so as to transfer the forward driving thrust from the propeller 38 through the thrust bearing 140, outer cage 116, and retainer ring 118 to the lower unit housing 28. Rearward driving thrusts are transmitted to the bearing carrier 82 and lower unit housing 28 from a rear facing thrust shoulder of the thrust flange 138. The rearward facing thrust shoulder of the thrust flange 138 engages a needle-type thrust bearing 142 having a race that is engaged with a shoulder of the bearing carrier 82. Because the thrust flange 138 and the bearing assemblies 140, 142 which journal the thrust flange 138 within the bearing casing 82 form no significant part of the invention, further description of these elements is not believed necessary for an understanding of the present transmission 80.

As seen in FIG. 3, the outer propulsion shaft 74 includes an integrally formed engagement sleeve 144 that extends from the thrust flange 138 in the forward direction. The engagement sleeve 144 has an outer diameter which is slightly smaller than the diameter of the counterbore 124 of the rear gear hub 114 so as to fit within the counterbore 124 of the rear gear hub 114. The engagement sleeve 144 also has an inner diameter which is sized to receive the rear clutch 98, as discussed below.

The inner propulsion shaft 52, as noted above, extends through front gear hub 102 where the needle bearing rows 104 journal the front end of the inner propulsion shaft 52 within the front gear 88. The inner propulsion shaft 52 also extends through the rear gear hub 114 and through the hollow outer propulsion shaft 74. As seen in FIG. 2, a needle bearing assembly 146 journals and supports the inner shaft 52 at the rear end of the outer propulsion shaft 74. The inner shaft 52 projects beyond the rear end of the outer shaft 74 to support the rear propeller 40.

With reference to FIG. 3, the front end of the inner propulsion shaft 52 includes a longitudinal bore 148 with a stepped diameter formed by a first section 150 and a smaller diameter second section 152. The first section 150 of the bore 148 stems from the front end of the inner shaft 52 to a transition surface 154 which is positioned on the rear side of the axis of the drive shaft 24. The second section 152 of the bore 148 stems from the transition surface 154 to a bottom surface 156 that generally coincides with the position of the thrust flange 138 in the axial direction.

As seen in FIG. 3, a front aperture 158 extends through the inner shaft 52, transverse to the axis of the longitudinal bore 148, at a position that is generally symmetrically between the driven gears 80, 40. The inner shaft 52 also includes a rear aperture 160 that extends transverse to the axis of the longitudinal bore 148 at a position within the hollow bearing hub 114 of the rear gear 90.

The plunger 100 has a generally cylindrical rod shape and slides within the longitudinal bore 148 of the inner shaft 52 to actuate the clutches 96, 98. In the illustrated embodiment, the plunger 100 comprises a hollow first segment 162 which houses a neutral detent mechanism 164. The detent mechanism 164 will be discussed below. The plunger 100 also includes a solid second segment 166. The plunger first segment 162 is sized to slide within the first section 150 of the longitudinal bore 148 at the front end of the propulsion shaft 52. The plunger second segment 166 is sized to slide within the second section 152 of the longitudinal bore 148 of the lower propulsion shaft 52. The second segment 166 also is sized to fit inside the first segment 162.

The plunger segments 162, 166 together define a front hole 168 that is positioned generally transverse to the longitudinal axis of the plunger 100, and the rear plunger segment 166 includes a rear hole 170 that is likewise positioned generally transverse to the longitudinal axis of the plunger 100. Each hole 168, 170 desirably is generally located symmetrically in relation to the corresponding apertures 158, 160 of the inner propulsion shaft 52.

As understood from FIG. 3, the forward end of the plunger 100 is captured within a slot formed in an actuating cam 172 which is slidably supported in a known manner in the front of the lower unit 28. The interconnection between the actuating cam 172 and the front end of the plunger 100 allows the plunger 100 to rotate with the inner shaft 52 relative to the actuating cam 172. The actuating cam 172 receives a crank portion 174 of an actuating rod 176 which is journaled for rotation in the lower unit 28 and extends upwardly to a transmission actuator mechanism (not shown). Rotation of the actuating rod 176 positively reciprocates the cam 172 and the plunger 100 so as to shift the clutches 96, 98 between a forward drive position in which the front and rear clutches 96, 98 engage the first and second gears 88, 90, respectively, a position of non-engagement (i.e., the neutral position shown in FIG. 3), and a reverse drive position in which the front clutch 96 engages the rear gear 90.

The transmission 80 also desirably includes the detent mechanism 164 which cooperates between the plunger 100 and the inner propulsion shaft 52 to retain the clutches 96, 98 in the neutral position and provide a predetermined force to resist shifting for torsionally loading the shift rod 176. The torsional loading of the shift rod 176 promotes snap engagement between the clutches 96, 98 and gears 88, 90 in the forward and reverse drive positions. This mechanism is of the type described in U.S. Pat. No. 4,570,776, issued Feb. 18, 1986, and entitled "Detent Mechanism for Clutches," which is assigned to the Assignee hereof. This patent provides full details of the detent mechanism, and also the clutch actuating mechanism as thus far described, and is hereby incorporated by reference.

The detent mechanism 164 includes a plurality of detent balls 178 retained within the hollow bore of the plunger first segment 162. A larger ball 180, urged by a compression spring 182, engages the detent balls 178. The opposite end of the spring 182 engages another large ball 184 which operates with the detent balls 186 to urge then into engagement with cam grooves 188 formed in the inner surface of the longitudinal groove 150 in the front end of the inner propulsion shaft 52. The detent balls 186, as illustrated in FIG. 3, also are urged into a further neutral locking groove 190. In view of the description of the detent mechanism incorporated by reference, a further description of the detent mechanism 164 is believed unnecessary.

As seen in FIG. 3, the front clutch 96 generally has a spool-like shape and includes an axial bore which extends between an annular front end plate 192 and an annular rear end plate 194. The bore is sized to receive the inner propulsion shaft 52.

The annular end plates 192, 194 of the front clutch 96 are substantially coextensive in size with the annular engagement surfaces 108, 110 of the front and rear gears 88, 90, respectively. The annular end plates 192, 194 each support a plurality of clutching teeth 196, 198 which correspond in size and number with the teeth 106, 112 formed on the respective engagement surfaces 108, 110 of the front and rear gears 88, 90.

The front clutch 96 has a spline connection (generally referenced as reference numeral 200) to the inner propulsion shaft 52. Internal splines of the front clutch 96 matingly engage external splines on the external surface of the inner drive shaft 52. This spline connection 200 provides a driving connection between the front clutch 96 and the inner propulsion shaft 52, while permitting the front clutch 96 to slide over the inner propulsion shaft 52, as discussed below.

Figure 4:
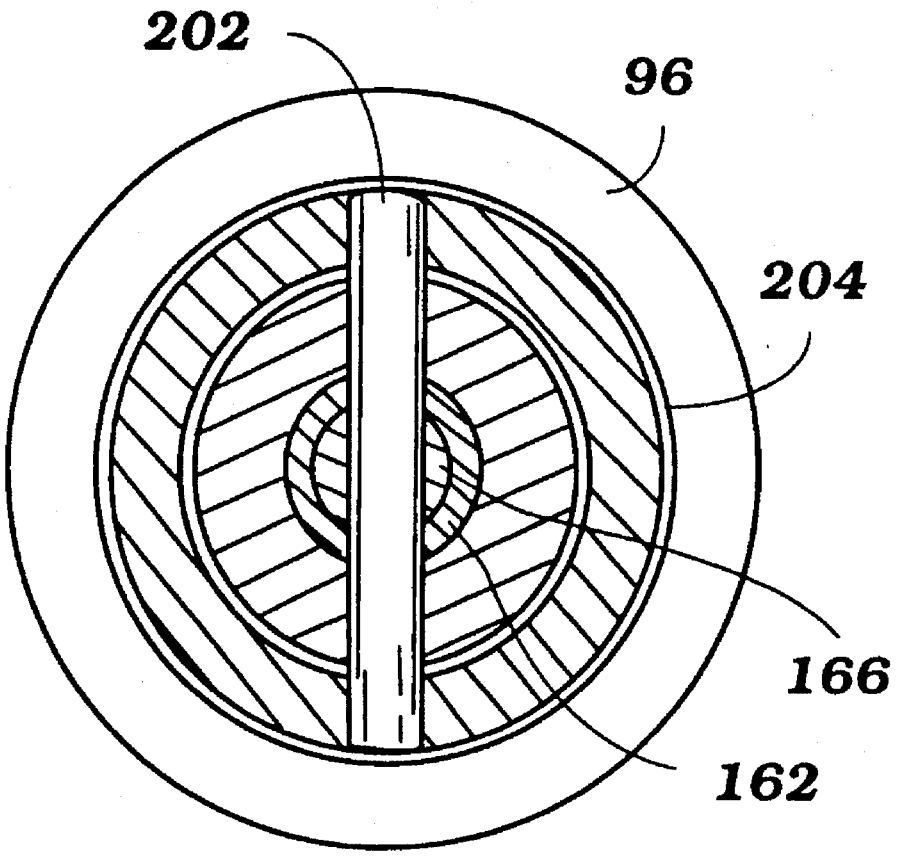
FIG. 4 is a cross-sectional view of a portion of the transmission of FIG. 3 taken along line 4—4.

With reference to FIGS. 3 and 4, the front dog clutch also includes a hole that extends through the midsection of the clutch 96 in a direction generally transverse to the longitudinal axis of the clutch 96. The hole is sized to receive a pin 202 which, when passed through the front aperture 158 of the inner propulsion shaft 52 and through front hole 168 of the plunger 100, interconnects the plunger 100 and the front clutch 96 with a portion of the inner shaft 52 interposed therebetween. The pin 202 also interconnects the first and second segments 162, 166 of the plunger 100 by passing through the corresponding aligned holes in the segments 162, 166, which together define the front hole 168 of the plunger 100. The pin 52 may be held in place by a press-fit connection between the pin and the front hole of the plunger 100, or, as seen in FIGS. 3 and 4, by a conventional coil spring 204 which is contained within a groove about the middle of the front clutch 96.

As also seen in FIG. 2, the rear clutch 98 has a cylindrical sleeve shape sized to fit within the engagement sleeve 144 of the outer propulsion shaft 74. External splines extend from the cylindrical external surface of the rear clutch 98. The external splines mate with corresponding internal splines on inner surface of the engagement sleeve 144 of the outer propulsion shaft 74 to establish a driving connection between the rear clutch 98 and the outer shaft 74, yet permit the clutch 98 to slide along the axis of the shaft 79 within the bearing hub 114 of the rear gear 90.

The rear clutch 98 also includes an axial bore which extends between an annular front end plate 206 and a rear end 208. The bore is sized to receive the inner propulsion shaft 52.

As best seen in FIG. 3, the rear clutch also includes a counterbore. The counterbore is sized to receive a pin 210 which extends through the rear aperture 160 of the inner propulsion shaft 52 and through the rear hole 170 of the plunger 100 when assembled. The ends of the pin 210 desirably are captured by an annular bushing 212 interposed between a pair of roller bearings. The assembly of the bushing 212 and bearings is captured between a pair of washers and locked within the counterbore of the clutch 98 by a retaining ring. The roller bearings journal the bushing 212 and pin 210 assembly within the counterbore of the rear clutch 98. In this manner, the rear clutch 98 is coupled to the plunger 100 so as to allow the plunger 100 to rotate in one direction and the clutch 98 to rotate in an opposite direction, while the clutch 98 is drivingly connected to the outer propulsion shaft 74.

The front annular end plate 206 of the rear clutch 98 is substantially coextensive in size with the rear annular engagement surface 128 of the rear gear 90. Teeth 214 extend from the front end plate 206 of the rear clutch 98 and desirably correspond to the teeth 130 of the rear gear 90 in size (e.g., axial length), in number, and in configuration.

As understood from FIG. 3, the operation of the rear clutch 98 occurs within the bearing hub 114 of the rear gear 90. That is, the movement of the clutch 98 from a position of non-engagement to a position of engagement occurs within the bearing hub 114 of the rear gear 90, and the driving connection between the rear clutch 98 and outer propulsion shaft 74 also occurs within the-bearing hub 114 of the rear gear 90.

The operation of the present transmission 80 will now be described with primary reference to FIG. 3. FIG. 3 illustrates the front and rear clutches 96, 98 in a neutral position, i.e., in a position of non-engagement with the gears 88, 90. The detent mechanism 164 retains the plunger 100 and coupled the clutches 96, 98 in this neutral position.

To establish a forward drive condition, the actuator cam 172 moves the plunger 100 forward, which in turn, slides the front and rear clutches 96, 98 forward over the inner propulsion shaft 52. The forward motion of the plunger 100 positively forces the front clutch 96 into engagement with the front gear 88 with the corresponding clutching teeth 106, 196 mating. The forward motion of the plunger 100 also positively forces the rear clutch 98 to engage the rear gear 90 with the corresponding clutching teeth 130, 214 mating.

So engaged, the front gear 88 drives the inner propulsion shaft 52 through the internal spline connection 200 between the clutch and inner propulsion shaft 52. The inner propulsion shaft 52 thus drives the rear propeller 40 (FIG. 2) in a first direction which assert a forward thrust. As understood from FIG. 3, the rear gear 90 similarly drives the outer propulsion shaft 74 through the external spline connection between the rear clutch 98 and outer propulsion shaft 74. The outer propulsion shaft thus drives the front propeller 38 (FIG. 2) to spin in an opposite direction to that of the rear propeller 40 and to assert a forward thrust.

With reference back to FIG. 3, to establish a reverse drive condition, the actuator cam 172 moves the plunger 100 in the rearward direction, which in turn, slides the front and rear clutches 96, 98 rearward over the inner propulsion shaft 52. The rearward motion of the plunger 100 positively forces the front clutch 96 to engage the rear gear 90 with the corresponding clutching teeth 112, 198 mating. So engaged, the rear gear 90 drives the inner propulsion shaft 52 through the internal spline connection 200 between the clutch 96 and inner propulsion shaft 52. The inner propulsion shaft 52 thus drives the rear propeller 40 (FIG. 2) in a direction which assert a reverse thrust to propel the watercraft 14 (FIG. 1) in a reverse direction.

As seen in FIG. 3, the rear clutch 98 slides within the overlapping engagement sleeve 144 and the bearing hub 114. The engagement sleeve 144 has a sufficient axial length to permit the rear clutch 98 to move from its neutral position in the rearward direction by a sufficient travel to allow the front clutch 96 to engage the rear gear 90 without interference.

Figure 5:
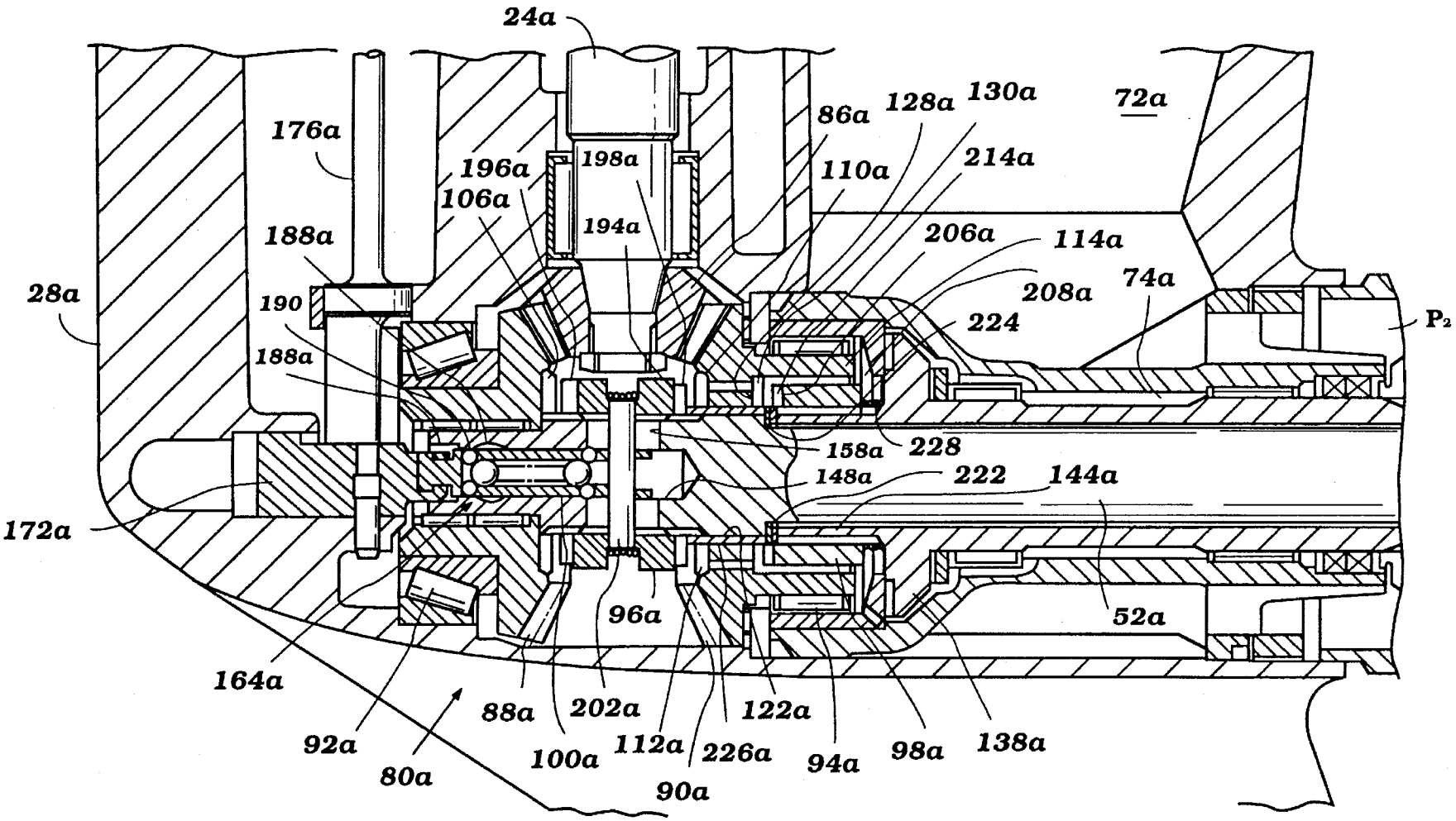
FIG. 5 is an enlarged, sectional side elevational view of a transmission configured in accordance with another preferred embodiment of the present invention.

FIG. 5 illustrates an additional preferred embodiment of the present transmission. Where appropriate, like numbers with an "a" suffix have been used to indicate like parts between the two embodiments for ease of understanding. The present transmission **80*a* is substantially identical to the transmission 80 described above, except from the clutch actuating mechanism and the arrangement of the rear clutch 98*a* relative to the rear gear 90*a* and the front end of the outer propulsion shaft 74*a*. Accordingly, the foregoing discussion should be understood as applying equally to the present transmission 80*a***, unless specified to the contrary.

As seen in FIG. 5, the rear clutch **98*a* is positioned about a portion of the outer propulsion shaft 74*a* within the hollow hub 114*a* of the rear driven gear 90*a*. The rear clutch 98*a* has a generally tubular body extending from a front engagement plate 206*a* to a rear end 208*a*. The front engagement plate 206*a* carries a series of clutching teeth 214*a* which selectively engage corresponding clutching teeth 130*a* carried by a rear engagement surface 128*a* of the rear gear 90*a*. The clutch 98*a* also includes an inner bore which extends between the front engagement surface 206*a* and the rear end 208*a*. The inner bore has a sufficient size to receive a portion of the inner propulsion shaft 52*a* and a portion of the outer propulsion shaft 74*a*, as seen in FIG. 5**.

In this embodiment, the outer propulsion shaft **74*a* includes an engagement sleeve 144*a* which extends forward of a thrust flange 138*a* of the shaft 74*a*. The engagement sleeve 144*a* has a outer diameter generally equal to the diameter of the outer propulsion shaft 74*a* behind the thrust flange 138*a* and is sized to fit within the inner bore of the rear clutch 98*a*. The engagement sleeve 144*a* also has an inner diameter which is sized to receive a portion of the inner propulsion shaft 52*a***.

A spline connection 220 couples the rear clutch **98*a* to the engagement sleeve 144 of the outer propulsion shaft 74*a*. Internal splines formed inside the inner bore of the rear clutch 98*a* mate with external splines formed on the exterior of the engagement sleeve 144*a* of the outer propulsion shaft 74*a*. The spline connection 220 allows the clutch 98*a* to rotatably drive the outer propulsion shaft 74*a*, yet allow the clutch 98*a* to slide over the shaft 74*a* relative to the rear gear 90*a* for selective engagement with the gear 90*a***, as discussed below.

As also seen in FIG. 5, the inner propulsion shaft **52*a* includes a step 222 formed by a step in shaft diameter. The step 222 is located within the hollow bearing hub 114*a* of the rear gear 90*a*, just forward of the end of the outer propulsion shaft engagement sleeve 144*a*. The inner propulsion shaft 52*a* transitions in diameter at the step 222 from a larger diameter, which generally matches the outer diameter of the engagement sleeve 144*a* of the outer propulsion shaft 74*a*, to a smaller diameter, which is slightly less than the inner diameter of the hollow outer propulsion shaft 74*a***.

A gap exists between the between the step 222 of the inner propulsion shaft **52*a* and the front end of the outer propulsion shaft 74*a*. An anti-friction washer 224 fills the gap. The washer 224 has an inner diameter sized to fit over the smaller diameter section of the inner shaft 52*a* and an outer diameter which is slightly larger than the outer diameter of the outer propulsion shaft engagement sleeve 144***a*. The washer 224, however, is configured not to interfere with the actuation of the rear clutch 98*a*.

In the embodiment illustrated in FIG. 5, the clutch actuation mechanism includes a hollow plunger 100*a* which slides within a longitudinal bore 148*a* of the inner propulsion shaft 52*a*. The longitudinal bore 148*a* extends to a point which generally coincides with the axial location of the rear gear 90*a* along the inner propulsion shaft 52*a*. The hollow plunger 100*a* carries the detent mechanism 164*a* described above, which cooperates with the retention and cam grooves 188*a*, 190*a* formed in the wall of longitudinal bore 148*a*.

A pin 202*a* connects a front clutch 96*a* to the plunger 100*a*. The pin 202*a* specifically passes a transverse aperture 158*a* formed in the inner propulsion shaft 52*a* and through a transverse hole formed at the end of the plunger 100*a*. The aperture 158*a* lies generally symmetrically between the front and rear driven gears 88*a*, 90*a* in assembly. A conventional spring coil secures the pin 202*a* in place.

The clutch actuation mechanism also includes a sleeve bushing 226 which passes through an inner bore 122*a* of the rear gear 90*a* and surrounds a portion of the inner propulsion shaft 52*a* in this position. The bushing 226 is sized to smoothly slide over the inner propulsion shaft 52*a* and through the inner bore 122*a* of the rear gear 90*a*, as discussed below. In the illustrated embodiment, the bearing sleeve 226 desirably is fixed to the inner shaft 52*a* in a manner which allows the sleeve 226 to slide over the shaft 52 in the forward and rearward directions, but which causes the sleeve 226 to rotate with the inner shaft 52. The bushing 226 thus journals the shaft 52 within the inner bore 122*a* of the rear gear 90*a*.

The bushing sleeve 226 extends between a rear engagement surface 194*a* of the front clutch 96*a* and a front engagement surface 206*a* of the rear clutch 98*a*, and contacts the respective engagement surfaces 194*a*, 206*a* at a location which does not interfere with the clutching operation of the front and rear clutches 96*a*, 98*a*. In the illustrated embodiment, the rear end of the bushing sleeve 226 directly contacts the anti-friction washer 224 which rests against the front engagement surface 206*a* of the rear clutch 98*a* to minimize friction between these components, which under the forward and reverse drive conditions rotate relative to each other.

At least one biasing member 228 (e.g., a compression spring) of the clutch actuation mechanism contacts the rear end 208*a* of the rear clutch 98*a*. The biasing member 228 biases the clutch 98*a* towards the rear engagement surface 128*a* of the rear gear 90*a*. The biasing member 228 extends between the rear end 208*a* of the rear clutch 98*a* and a front surface of the outer propulsion shaft thrust flange 138*a*.

The following elaborates on the previous description of the operation of the present transmission 80*a*. FIG. 5 illustrates the front and rear clutches 96*a*, 98*a* in a neutral position. The detent mechanism 164*a* retains the plunger 100*a* in this neutral position with the drive pin 202*a* and the connected front clutch 96*c* positioned generally symmetrically between the front and rear gears 88*a*, 90*a*.

The bearing sleeve 226 acts as a spacer between the front and rear clutches 96*a*, 98*a* and prevents the rear clutch 96*a* from moving in the forward direction, despite the bias in this direction produced by the biasing member 228. The biasing member 228 urges the rear clutch 98*a* into contact with the bearing sleeve 226, and inhibits movement of the rear clutch 98*a* in the rearward direction (i.e., in a direction towards the propellers 38, 40). In this manner, the combination of the bearing sleeve 226 and the biasing member 228 couple the rear clutch 98*a* with the front clutch 96*a* such that these clutching elements 96*c*, 98*a* move together, as well as maintain the position of the rear clutch 98*a* relative to the front clutch 98*a*.

To establish the forward drive condition, an actuator cam 172*a* moves the plunger 100*a* forward, which in turn, slides the front clutch 96*a* forward over the inner propulsion shaft 52*a*. The forward motion of the plunger 100*a* positively forces the front clutch 96*a* to engage the front gear 88*a* with the corresponding clutching teeth 106*a* mating. So engaged, the front gear 88*a* drives the inner propulsion shaft 52*a* through the spline connection 200*a* between the clutch 96*a* and inner propulsion shaft 52*a*. The inner propulsion shaft 52 thus drives the rear propeller 40 (FIG. 1) in a first direction which assert a forward thrust.

As seen in FIG. 5, the biasing member 228 urges the rear clutch 98*a* to follow the forward motion of the front clutch 96*a*. The bearing sleeve 226 slides over the inner shaft 52*a* between the clutches 96*a*, 98*a* as the clutches 96*a*, 98*a* simultaneously move in the forward direction. The biasing member 228 forces the rear clutch 98*a* into engagement with the rear clutching surface 206*a* of the rear gear 90*a* within the hollow bearing hub 114*a* of the rear gear 90*a*. The corresponding teeth 130*a*, 214*a* of the rear gear 90*a* and rear clutch 98*a* mate to establish a drive condition between these elements. So engaged, the rear gear 90*a* drives the outer propulsion shaft 74*a* through the spline connection 220 between the rear clutch 98*a* and outer propulsion shaft 74*a*. The outer propulsion shaft 74*a* thus drives the front propeller 38 (FIG. 1) to spin in an opposite direction to that of the rear propeller 40 and to assert a forward thrust.

With reference back to FIG. 5, to establish a rear drive condition, the actuator cam 172*a* moves the plunger 100 in the rearward direction, forcing the front teeth 196*a* of the front clutch 98*a* to disengage the corresponding teeth 106*a* of the front gear 88*a*. The rearward motion of the front clutch 96*a* also forces the bearing sleeve 226 to slide over the inner propulsion shaft 52*a*, which, in turn, forces the rear clutch 98*a* to disengage the rear gear 90*a* and compresses the biasing member 228.

Continual rearward movement of the plunger 100*a* moves both clutches 96*a*, 98*a* through the neutral position to a position where the front clutch 96*a* engages the rear gear 90*a*. Specifically, the clutching teeth 198*a* on the rear engagement surface 194*a* of the front clutch 96*a* mate with the clutching teeth 112*a* on the front engagement end 110*a* of the rear gear 90*a*. The rear gear 90*a* thus drives the clutch 96*a* and the connected inner propulsion shaft 52*a* through this positive coupling. The inner propulsion shaft 52*a* in turn drives the rear propeller 40 (FIG. 1) to spin in a direction which asserts a thrust to drive the watercraft 14 in a reverse direction.

As understood from FIG. 5, the rear clutch 98*a* compresses the biasing member further when moved from its neutral position to a reverse drive position. The increased biasing force applied by the biasing member 228 in the forward direction due to its additional compression assists the clutch actuator mechanism when disengaging the front clutch 98*a* from the rear gear 90*a*.

As common to both embodiments described above, the operation of the rear clutch of the present transmission occurs primarily within the hollow bearing sleeve of the rear gear, and the clutching mechanism generally lies to the front of the rear end of the rear gear hub. A portion of the outer propulsion shaft thus desirably extends forward of the rear end of the rear bearing hub to connect to a portion of the clutching mechanism. This configuration of the clutching mechanism reduces the length of the transmission along the axis of the propulsion shafts to provide more space within the lower unit behind the transmission for exhaust discharge.

This increased flow area behind the transmission at the transition of the exhaust discharge duct within the lower unit to the exhaust discharge passage P formed through the propellers allows for a smoother discharge of exhaust gases from the engine. The increased flow area also increases the exhaust discharge capacity of the exhaust system of the outboard drive to accommodate larger size engines.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A transmission for a watercraft outboard drive, said transmission comprising first and second counter-rotating gears, a first clutch connected to a first propulsion shaft and adapted to selectively engage either said first gear or second gear, and a second clutch coupled to said first clutch and connected to a second propulsion shaft, said second clutch adapted to selectively engage said second gear in a manner in which a substantial portion of a body of said second clutch lies within said second gear with said second clutch engaging said second gear.

2. The transmission of claim 1, wherein said second gear comprises a bearing hub which defines a bore and an inner clutch engagement surface formed within said bore, said second clutch configured to move within said bore from an engagement position in which said second clutch engages said inner clutch engagement surface of said second gear to a non-engagement position in which said second clutch does not engage said inner clutch engagement surface of said second gear.

3. The transmission of claim 2, wherein said second gear further defines an inner bore which extends through said bore in hub, said inner bore sized to receive said first propulsion shaft.

4. The transmission of claim 2, wherein said bore has a sufficient size to receive a portion of said second propulsion shaft.

5. The transmission of claim 4, wherein said second propulsion shaft has a first end sized to fit within said bore of said second gear hub, said first end of said second propulsion shaft defining a bore sized to receive at least a portion of said second clutch.

6. The transmission of claim 5, wherein said second clutch includes a plurality of external splines and said second propulsion shaft includes a plurality of corresponding internal splines formed within said bore of said first end of said second propulsion shaft which mate with said splines of said clutch to establish a driving connection.

7. The transmission of claim 5, wherein said second propulsion shaft includes an axial bore which receives said first propulsion shaft.

8. The transmission of claim 4, wherein said bore of said second gear hub is configured to receive said second clutch with said second clutch positioned over said second propulsion shaft.

9. The transmission of claim 8, wherein said second clutch includes an inner bore with a plurality of internal splines and said second propulsion shaft includes a plurality of corresponding external splines which mate with said internal splines of said second clutch.

10. The transmission of claim 9, wherein said second propulsion shaft includes an axial bore which receives said first propulsion shaft.

11. The transmission of claim 2, wherein second gear includes a plurality of oil passages which extend from a side of the gear proximate to said first clutch into said bore of said gear bearing hub.

12. A transmission for a watercraft outboard drive, said transmission comprising first and second counter-rotating gears, at least one of said gears including a hollow bearing hub, and a clutch which is at least partially positioned within said hub, said clutch adapted to move within said hub from an engagement position in which said clutch engages said gear to a non-engagement position in which said clutch does not engage said gear.

13. The transmission of claim 12, wherein said gear includes a clutch engagement surface formed inside hub.

14. The transmission of claim 13, wherein said clutch is coupled to a propulsion shaft, and said engagement surface of said gear is positioned transversely to an axis of said propulsion shaft.

15. The transmission of claim 14, wherein said propulsion shaft drives a propulsion device, and said clutch is positioned on the side of said gear which is proximate to the propulsion device.

16. The transmission of claim 13, wherein said clutch and said engagement surface of said gear comprise corresponding teeth which mate in said engagement position.

17. The transmission of claim 12 additionally comprising a second clutch which is disposed between said first and second gears and is adapted to selectively engage either said first gear or said second gear.

18. A compacted transmission for a watercraft outboard drive, said transmission comprising first and second counter-rotating gears, a first clutch connected to a first propulsion shaft and adapted to selectively engage at least said first gear, and a second clutch coupled to said first clutch and connected to a second propulsion shaft, said second clutch adapted to selectively engage at least said second gear, said first and second propulsion shafts extending in an axial direction, at least one of said gears and at least one of said clutches overlapping with each other in said axial direction so as to reduce an overall length of said transmission in said axial direction.

19. The transmission of claim 18, wherein said overlapping clutch and gear are supported about both of said propulsion shafts.

20. The transmission of claim 18, wherein said overlapping clutch and gear also overlap a portion of both of said propulsion shafts in the axial direction.

21. An outboard drive for a watercraft comprising coaxial propulsion shafts which extend in a rearward direction from a transmission, said transmission comprising a front rotating gear and a rear counter-rotating gear, said rear gear having at least one clutch element, and a clutching mechanism comprising a movable first clutching element positioned on the rear side of said clutch element of said rear gear, said clutching mechanism being configured to selectively couple said propulsion shafts with said gears to simultaneously drive said propulsion shafts in opposite directions relative to each other under a first drive condition, and to couple one of said propulsion shafts with one of said gears under a second drive condition, said clutching mechanism being arranged forward of a rear end of said rear gear of said transmission.

22. The outboard drive of claim 21, wherein said clutching mechanism comprises a second clutching element interposed between said front and rear gears and connected to one of said propulsion shafts with said first clutching element positioned on a side of said rear gear opposite of said second clutching element, said first clutching element connected to the other of said propulsion shafts.

23. The outboard drive of claim 22, wherein said rear gear comprises a hollow bearing hub and said first clutching element is positioned at least partially within said hub.

24. The outboard drive of claim 23, wherein said first clutching element is positioned about both of said propulsion shafts.

25. The outboard drive of claim 23, wherein at least a portion of said first clutching element is positioned between said propulsion shafts.

26. The outboard drive of claim 25, wherein said bearing hub of said rear gear receives portions of both propulsion shafts.

27. An outboard drive for a watercraft comprising an inner propulsion shaft and a hollow outer propulsion shaft which are positioned coaxially with each other, and a transmission including front and rear counter-rotating gears, and a clutching mechanism which selectively couples said gears with said propulsion shafts, said clutching mechanism comprising a first clutching element interposed between said front and rear gears and connected to said inner propulsion shaft, and a second clutching element positioned on a side of said rear gear opposite of said first clutching element, said second clutching element connected to said outer propulsion shaft, said outer propulsion shaft being arranged to extend forward of a rear end of said rear transmission gear.

28. The outboard drive of claim 27, wherein said rear gear comprises a hollow bearing hub and said second clutching element is at positioned within said hub.

29. The outboard drive of claim 28, wherein said second clutching element is positioned about both inner and outer propulsion shafts.

30. The outboard drive of claim 28, wherein at least a portion of said second clutching element is positioned between said inner propulsion shaft and said outer propulsion shaft.

31. The outboard drive of claim 30, wherein said bearing hub of said rear gear receives a portions of both said inner propulsion shaft and said outer propulsion shaft.

* * * * *